United States Patent [19]

Kelly et al.

[11] Patent Number: 4,876,837

[45] Date of Patent: Oct. 31, 1989

[54] CORNER BEAD STRUCTURE

[75] Inventors: Patrick M. Kelly, Cleveland; Robert E. Howlett, Middleburg Heights; Paul A. Pomeroy, Spencer; Dennis A. Alvarez, Euclid, all of Ohio

[73] Assignee: USG Interiors, Inc., Chicago, Ill.

[21] Appl. No.: 234,810

[22] Filed: Aug. 22, 1988

[51] Int. Cl.[4] ..... E04B 2/00; E04F 13/06

[52] U.S. Cl. ..... 52/287; 52/254; 72/180

[58] Field of Search ..... 52/288, 287, 254, 255, 52/256, 257, 278, 738

[56] References Cited

U.S. PATENT DOCUMENTS

| | | | |
|---|---|---|---|
| 831,755 | 9/1906 | Vietor | 52/729 |
| 1,362,439 | 12/1920 | Roberts | 52/738 |
| 3,165,815 | 1/1965 | Wogerbauer | 72/177 |
| 3,209,432 | 10/1965 | Cape | 52/720 |
| 3,255,561 | 6/1966 | Cable | 52/255 |
| 3,307,313 | 3/1967 | Tatum | 52/255 |
| 3,391,509 | 7/1968 | Fruman | 52/255 |
| 4,233,833 | 11/1980 | Balinsky | 72/180 |
| 4,291,562 | 9/1981 | Orr | 72/205 |
| 4,317,350 | 3/1982 | Sivachenko | 72/177 |
| 4,553,363 | 11/1985 | Weinar | 52/288 |

*Primary Examiner*—John E. Murtagh

*Attorney, Agent, or Firm*—Pearne, Gordon, McCoy & Granger

[57] ABSTRACT

A drywall corner bead providing a rounded nose and two mounting flanges extending from opposite sides of the nose is formed from a strip of galvanized metal of uniform thickness. The two flanges are provided with three discrete longitudinally extending bands of reduced thickness formed by shear deformation of the material forming the band. The flanges are knurled to emboss the surface thereof and openings are formed in the flanges at intervals along their length. The corner bead is formed by a method in which shear deforming forces are progressively applied to the material forming the thinned bands to produce lateral deformation of such material without any appreciable lengthwise deformation. After the thinned bands are formed, forces are applied to straighten the corner bead. Subsequently, the flanges are knurled to provide an embossed surface and holes are punched in the flanges at intervals along their length. Thereafter, the nose is formed to its final shape and the flanges are positioned at substantially right angles relative to each other.

16 Claims, 4 Drawing Sheets

CORNER BEAD STRUCTURE

BACKGROUND OF THE INVENTION

This invention relates to a novel and improved corner bead for drywall construction and the like, and to a novel and improved method for producing such corner bead.

PRIOR ART

Corner bead is usually installed at outside corners in drywall construction. Such corner bead is formed, generally by roll-forming, from an elongated strip of sheet metal, and provides a rounded nose and two mounting flanges extending at right angles from the opposite sides of the nose. The mounting flanges are often knurled or embossed to provide a rough surface so that the joint compound will adhere when the corner is finished.

The corner bead is installed by securing the mounting flanges along the surface of the drywall panels adjacent to the corners by a clench or nail connection. Thereafter, joint compound is applied over the flanges to the nose and a finished, smooth corner is provided.

Such corner bead is generally produced in high-speed rolling mills which produce the corner bead bY bending and forming flat sheet metal strips. Because such corner bead is produced by rolling processes, the labor content of the product is minimal, and the material costs of the product constitute by far the largest cost in producing the corner bead.

In order to reduce cost, corner beads have been produced in which the flanges are slit and expanded laterally to provide expanded metal-type flanges. It is also known to produce corner bead with a narrow metallic nose combined with stiff paper mounting flanges. Such products can be produced at reduced material cost but have not achieved significant acceptance in the marketplace, possibly because users have felt that the corner bead was not sufficiently strong and because it is difficult to handle and install in a perfectly straight condition necessary for a satisfactory finished corner.

SUMMARY OF THE INVENTION

The present invention provides a novel and improved corner bead for drywall corners and the like which has a reduced material content and cost. The present invention also provides a novel and improved method for producing such corner bead.

The finished metal corner bead of this invention provides a rounded nose having one metal thickness and two mounting flanges extending at substantially right angles from the nose having a reduced metal thickness. The corner bead has the appearance, handling and installation characteristics which are substantially identical to existing corner bead structures of uniform thickness. However, the material content, and consequently the cost of the corner beads incorporating this invention, is substantially reduced.

The corner bead is produced from a strip of flat sheet metal having a uniform thickness. The corner bead provides a nose portion which retains the original thickness of the strip of metal. The flanges, however, are substantially thinned by shear deformation to increase the width of the metal forming the flanges. Therefore, a finished corner bead is produced having the same overall dimensions as typical prior art corner bead, but is manufactured from a narrower strip of sheet metal stock. With the present invention, material savings of about 21% can be achieved. For example, a corner bead in accordance with this invention can be produced from a strip of metal 1.925 inch wide that has the same overall dimension of a prior art corner bead requiring a strip of identical metal 2.4375 inch wide.

The shear deformation of the metal forming the mounting flanges is accomplished in the illustrated embodiment, by a method and apparatus disclosed in the copending application for U.S. Pat. Ser. No. 07/019,214, filed Feb. 26, 1987, now U.S. Pat. NO. 4,770,018 assigned to the assignee of the present invention. Such application is incorporated herein in its entirety to provide a more detailed disclosure of the method and apparatus for shear deformation of elongated strips of metal.

The flanges of the illustrated embodiment each provide three laterally spaced, longitudinal bands of substantially reduced thickness. The portions of each flange between each band of reduced thickness and the edge thereof remote from the nose have substantially the same thickness as the nose. The flanges are knurled or embossed to provide a rough surface to which joint compound provides a good mechanical bond. Further, the flanges are provided with spaced openings which may be used for nailing the corner bead into position during installation, and which also improve the interlocking with the joint compound.

In accordance with the illustrated method of producing the corner bead, a strip of metal is first passed through a rolling mill which progressively applies shear deformation forces to the metal along opposite sides of the central portion of the strip which ultimately becomes the nose of the corner bead. These shear forces are applied so that the metal which ultimately becomes the flanges is shear deformed in a direction perpendicular to the length of the strip and without any substantial longitudinal deformation.

These shear forces produce narrow bands of reduced thickness, and, by sequentially applying shear forces to adjacent unthinned portions, the width of the bands are increased. The amount of thinning achieved in such sequential applications of shear forces tends to decrease, probably due to work-hardening of the material. Therefore, after a first sequence of sequential thinning operations is performed, a portion of the strip immediately adjacent to the thinned band is skipped over and a second sequence of shear deformation force applications is applied which again produces substantial thinning. In the illustrated embodiment three sequences are used to produce an increase in the width of the metal forming the flange by thinning the metal of the bands by about fifty percent.

Preferably, the final shear deformation and consequent thinning are terminated while leaving a narrow band about ⅛ inch wide of original metal thickness along the edge of the flange remote from the nose. This unthinned edge band provides stability to the flange, and tends to hold the flanges straight. Further, since clinches are often formed in the edges of the strip to mount the corner bead the unthinned edges provide additional strength.

In practice, it has been found that the thinned bands tend to elongate a very small amount and result in a waviness or non-straight condition because the central portion of the strip is not correspondingly increased in length. Therefore, subsequent forces are applied which cause a very slight increase in the length of the unthinned central portion to increase the straightness of the strip.

The strip is thereafter punched and passed through rolls which emboss or knurl the flange portion of the strip to provide an embossed irregular surface so that the joint compound will form a strong mechanical bond with the flanges Also, the nails sometimes used to mount the corner beads can be inserted through the punched holes. These holes also provide an improved interlocking bond with the joint compound. Further, the embossing and the punching of the holes also function to improve the straightness of the strip, which is then roll-formed to its final shape and cut to length.

With this invention, substantial savings in costs of production of corner beads are achieved, while providing a corner bead structure which is functionally equal to existing prior art corner beads.

These and other aspects of the invention are illustrated in the accompanying drawings and are more fully described in the following specification.

DETAILED DESCRIPTION OF THE DRAWINGS

Figure 1:
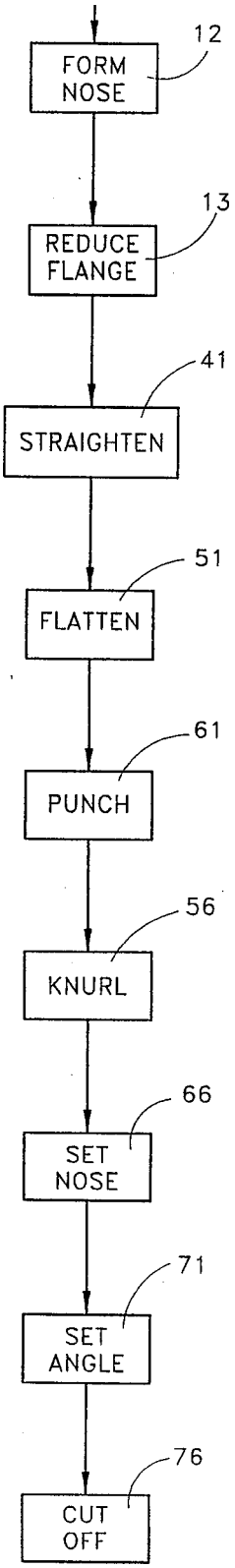
FIG. 1 is a block diagram illustrating the sequential steps of producing corner bead in accordance with this invention.
Figure 2:
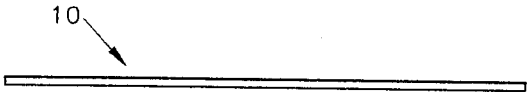
FIG. 2 is a cross section of the strip of metal from which the corner bead is formed.

FIG. 1 illustrates, with a block diagram, the sequential steps which are performed to produce a corner bead structure in accordance with the present invention. These sequential steps are performed in the illustrated embodiment by a rolling mill through which a flat strip 10 of metal, initially having a uniform thickness, progressively moves. Preferably, the strip 10 is hot dip galvanized, cold-rolled, common quality 1006 steel which provides a thin corrosion-resistant zinc coating. Such coating, which is not illustrated, because it is very thin, remains substantially undamaged during the various forming operations.

Figure 3:
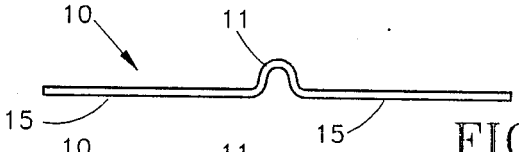
FIG. 3 is a cross section illustrating the first intermediate strip shape after the preliminary nose is formed thereon.

In the first operation, the strip of metal 10 is bent along its center to provide a preliminary nose 11 and coplanar flanges 15. The preliminary nose is formed during the first operation illustrated at the box 12 by simple bending and does not result in any change in the thickness of the metal forming the strip 10. The preliminary nose 11 is provided with a generally U-shaped profile, as best illustrated in FIG. 3.

In the subsequent rolling operations, the metal of the flanges 15 along each side of the preliminary nose 11 is thinned by shear deformation without any significant longitudinal deformation. This shear deformation of the strip is represented by the second box 13 and results in a strip, in the illustrated embodiment, having three discrete thinned bands 16, 17, and 18 along the flanges 15 on each side of the preliminary nose 11. The bands 16 and 17 are separated by a first unthinned portion 19 and the bands 17 and 18 are separated by a second unthinned, longitudinal portion 21.

At the completion of the shear deformation or flange reduction operation, the preliminary nose 11 continues to have a thickness equal to the original thickness of the strip 10 and the metal forming the bands 16, 17, and 18 is preferably reduced so that the bands have a thickness equal to about one-half of the original thickness of the material forming the bands. Also, the lateral extremities of the strip 22 are not thinned and remain at the original thickness of the strip.

Figure 11:
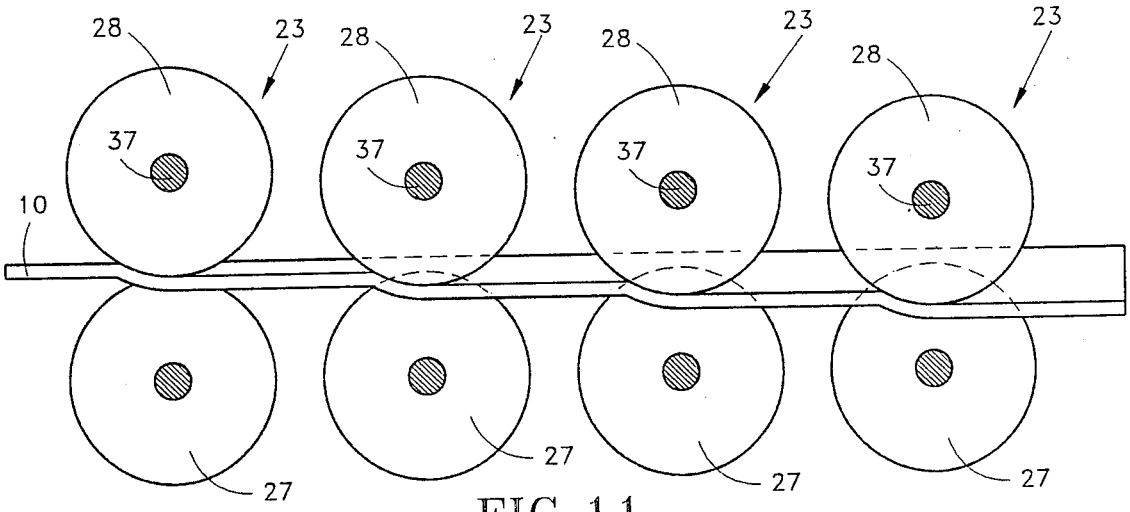
FIG. 11 is a schematic side elevation of the apparatus for producing the shear deformation of the strip to produce thinned bands along the flanges thereof.
Figure 12:
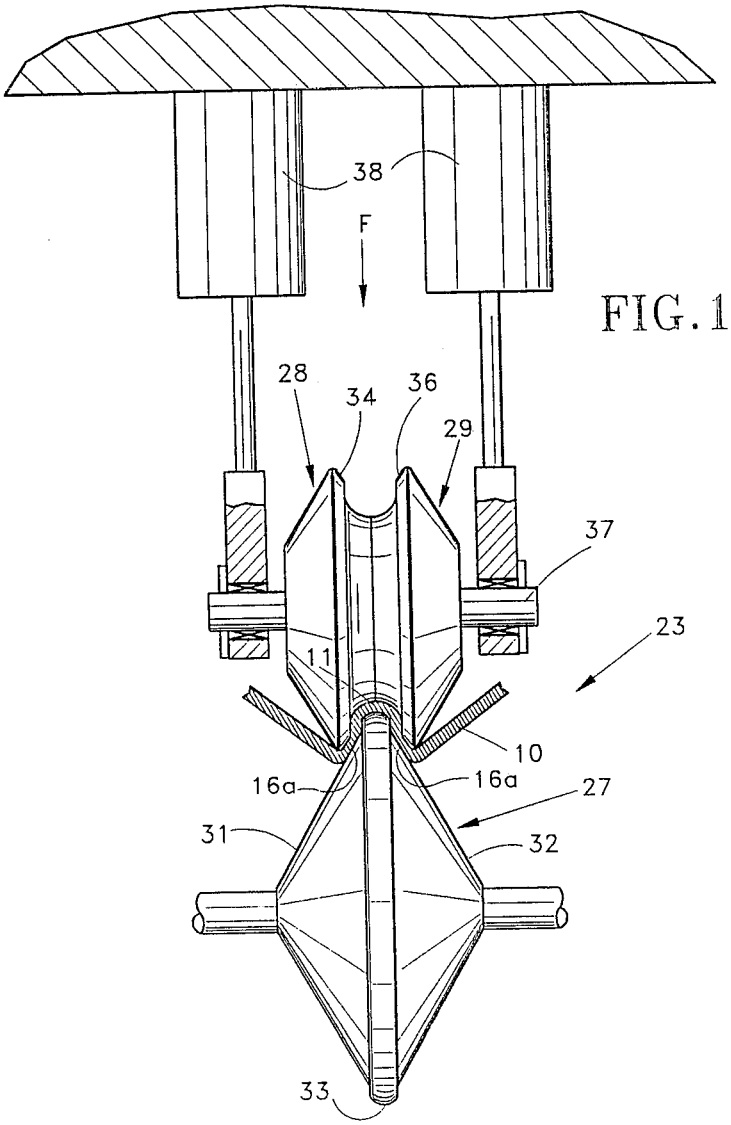
FIG. 12 is a schematic lateral view of the apparatus of the first shear deforming station in which initial shear deformation occurs.
Figure 13:
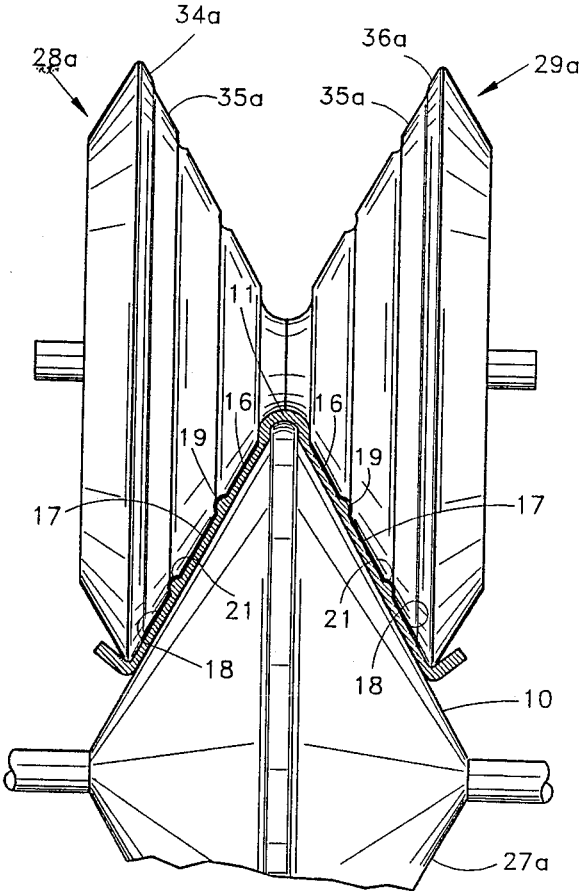
FIG. 13 is a schematic, lateral view of the apparatus of the last shear deformation station.

The apparatus for producing the shear deformation and the thinning of the flanges is schematically illustrated in FIGS. 11 through 13. Such apparatus includes a plurality of Work stations 23, schematically illustrated in FIG. 11. FIG. 12 schematically illustrates the apparatus at the first work station 23 where the initial shear deformation is performed. At such work station, the strip 10 passes between a rotating mandrel 27 and a pair of similar but opposite, laterally abutting pressure rolls 28 and 29. The mandrel 27 is provided with opposed conical surfaces 31 and 32 and a central peripheral portion 33 shaped to mate with the interior of the preliminary nose 11 Which supports the preliminary nose 11.

The two pressure rolls 28 and 29 are provided with narrow, conical working faces 34 and 36, respectively, each having the same cone angle as the associated conical faces 31 and 32 of the mandrel 27. Between the two working faces 34 and 36, the rolls are shaped to mate with the exterior preliminary nose and confine the metal thereof without causing thinning of the preliminary nose. The two pressure rolls are journaled on a shaft 37 connected to a pair of piston and cylinder actuators 38. Pressure supplied to the actuators 38 produces a downward force F urging the pressure rolls 28 and 29 toward the mandrel 27 to produce shear deformation of the metal forming the strip 10 between the working face 34 and the conical surface 31 on one side of the preliminary nose 11 and between the working face 36 and the conical surface 32 on the other side of the preliminary nose 11.

The pressure rolls and the mandrel operate to apply forces to the opposite surfaces of the strip 10 in a lateral direction with respect to the strip, and without any appreciable longitudinal component. Such forces function to produce lateral shear deformation of the material of the strip and produce a narrow, thinned band **16*a* extending longitudinally of the strip on each side of the preliminary nose 11. In the illustrated embodiment, the reduction of thickness of the material forming the band 16*a* is almost fifty percent. Therefore, it has a thickness of about one-half the thickness of the material forming the preliminary nose 11** and also the remainder of the strip.

Figure 4:
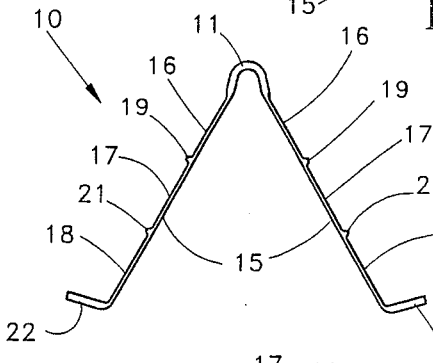
FIG. 4 is a cross section illustrating the second intermediate strip shape after shear deformation has been completed to reduce the thickness of the flanges.

The thinned band **16*a* formed on each side of the preliminary nose 11 is substantially narrower than the required thinned band 16 illustrated in FIG. 4. Therefore, in the next work station 23 a similar apparatus is provided which thins the portion of the metal along the sides of the bands 16*a* remote from the preliminary nose 11 to increase the width of the thinned band, and such procedure is repeated at subsequent work stations 23 until a thinned band having a width of the thinned band 16 is formed on each side of the preliminary nose, as illustrated in FIG. 4. After the thinned band 16 is formed, similar apparatus at subsequent work stations of the same type progressively forms thinned bands 17 and 18. However at the completion of the thinned band 16 the apparatus is sized to skip over the unthinned portion 19 and commence the thinning operations to produce the thinned band 17. Such skipover is provided to re-establish a thinning in material of the strip which has not been work-hardened by previous thinning operations. Similarly, a skip is made at the location 21 after the completion of the thinned band 17, and in multiple passes, the thinned band 18** is produced.

FIG. 13 illustrates the final thinning operation in which the thinned band 18 is completed. Here again, the strip 10 is passed between pressure rolls **28*a* and 29*a* which cooperate with a mandrel 27*a* to increase the width of the band 18 to its final width. The pressure rolls 28*a* and 29*a* are preferably formed with conical containment surfaces 35*a* which are relieved back slightly from the working surfaces 34*a* and 36*a*. These containment surfaces 35*a* function to apply sufficient pressure to the previously thinned portion of the band 18** to prevent back flow of metal into the previously thinned portion. This ensures that the flow of metal is in a lateral direction toward the edges of the strip.

The number of sequential thinning operations performed between each skip is determined by the material being thinned and, in the illustrated embodiment, involves three progressive thinning stations for each band 16, 17, and 18.

Reference should be made to the application Ser. No. 07/019,214, incorporated by reference above, for a more detailed description of the manner in which the thinning operations are performed and the apparatus for performing such operations.

In the illustrated embodiment, the production of the three thinned bands 16, 17, and 18 on each side of the preliminary nose 11 results in an increase in width of the strip by about twenty-one percent. However, even if the thinning results in a smaller increase in the width of the strip, for example, a fifteen percent increase in strip width, substantial cost savings ar achieved.

The thinned band 18 extends to an unthinned portion 22 at each extremity of the strip. This portion which is unthinned tends to maintain straightness of the strip and is therefore left at its original thickness. Also when clinches are used to mount the corner bead, they are formed in the unthinned edges.

With this shear deformation, virtually all of the displacement of the metal occurring during the thinning operations is laterally with respect to the length of the strip. However, even if very minute amounts of elongation deformation occur, for example, less than one percent the resulting strip is not completely straight. It is believed that this is because the metal of the preliminary nose portion does not elongate during the thinning operations, but that very slight amounts of elongation occur along the thinned bands 16, 17, and 18.

Figure 14:
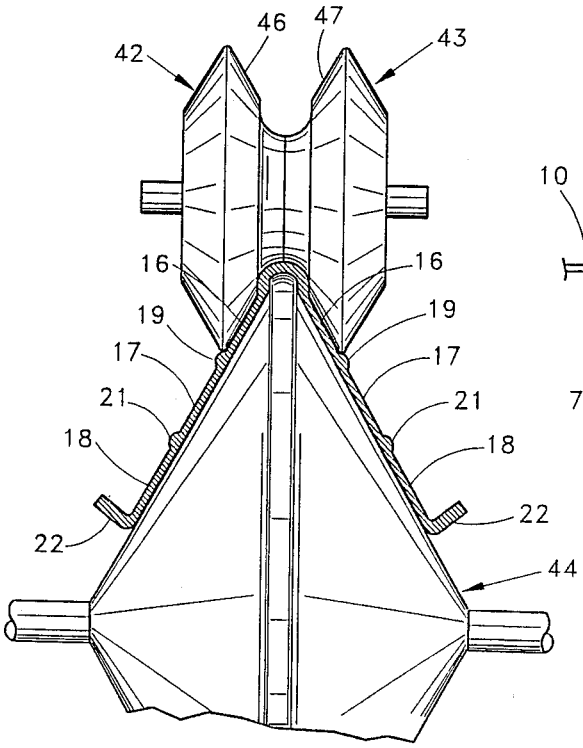
FIG. 14 is a lateral view of the apparatus for producing additional thinning of the band adjacent to the nose which operates to slightly increase the length of the nose and improve the straightness of the strip.

Since it is necessary that the ultimate corner bead be very straight and the flanges planar, a straightening operation is performed, as illustrated in FIG. 14 and as represented by the box 41 in FIG. 1. In this operation, a pair of relatively wide pressure rolls 42 and 43 cooperate with a mandrel 44 to perform a slight amount of additional thinning of the bands 16.

Figure 5:
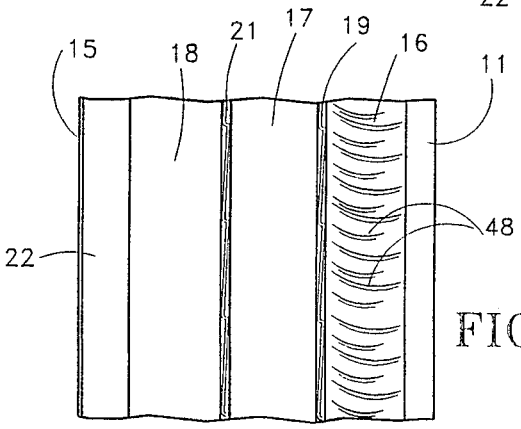
FIG. 5 is a side elevation of one of the flanges of a third intermediate strip shape after the bands closest to the nose have been subjected to a second thinning step which causes a slight elongation of the unthinned nose to improve the straightness of the strip.

In this work station, the pressure rolls 42 and 43 are provided with conical working faces 46 and 47, respectively, having a width substantially equal to the width of the previously thinned band 16. Such rolls having such wide working faces produce deformation which includes longitudinal flow of the material forming the two thinned bands 16, and produce an intermediate strip as illustrated in FIG. 5, in which the thinned band 16 has been further thinned and subjected to longitudinal deformation. This creates shallow ripples 48 along the thinned band between the preliminary nose portion 11 and the first unthinned portion 19. These internal stresses producing these ripples 48 also stretch the material forming the preliminary nose 11 a small amount so as to reduce the non-straightness of the two flanges 15 on each side of the preliminary nose.

Figure 6:
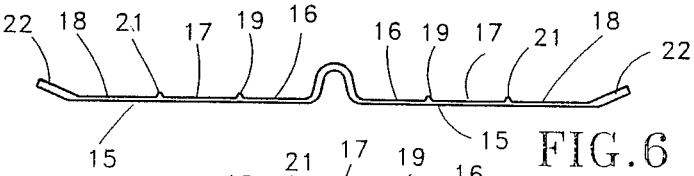
FIG. 6 is a cross section of the strip after it has been flattened to position the flanges coplanar for subsequent operations.

The next sequence of operation involves the flattening represented by the box 51, in which the strip 10 is passed between rolls which bend the flanges 15 to a substantially coplanar condition illustrated in FIG. 6 without significantly changing the shape of the preliminary nose 11, and while bending the unthinned portions 22 to a position substantially coplanar with the flanges 15.

In the next operation, holes 62 and 63 are punched in the two flanges 15 at intervals along the length thereof as represented by the box 61. The apparatus for performing these punching operations can be of any suitable type capable of producing a pattern of openings 62 and 63 (illustrated in FIG. 7) at intervals along the length of each of the flanges 15. These openings, which are typically formed in corner beads at intervals along the flanges thereof, function to provide an interlocking structure to better lock the joint compound in position. Further, in instances in which nails are used to mount the corner bead, nails can be inserted through the openings 62 or 63. However, typically, a clench is formed in the flanges by a clench tool when the corner bead is installed. These openings 62 and 63 are believed to provide even further straightening of the flanges and of the strip, which is believed to be the result of further stress relief and stress redistribution in the material forming the strip.

Figure 7:
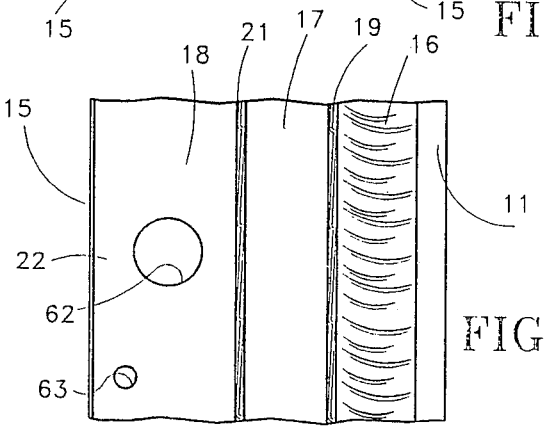
FIG. 7 a side elevation of one of the flanges of the subsequent intermediate strip formed after the flanges have been punched.
Figure 15:
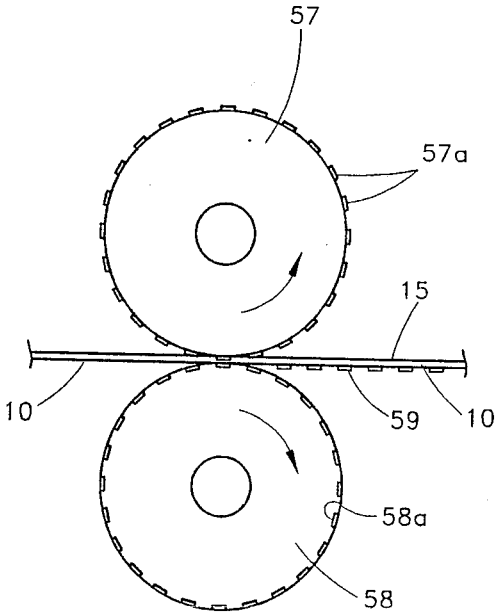
FIG. 15 is a schematic side elevation of the knurling rolls which emboss the flanges.

Thereafter, the strip illustrated in FIG. 7 is passed through knurling rolls represented by the box 56 and illustrated at 57 and 58 in FIG. 15. These knurling rolls are formed with mating projections 57*a* and recesses 58*a* which emboss the two flanges 15 and provide an intermediate strip having flanges 15, best illustrated in FIGS. 8 through 8*c*. The knurling rolls are shaped so that during the knurling operation, they do not engage the preliminary nose 11, but only engage the flanges 15 on the opposite sides of the preliminary nose 11.

Figure 8:
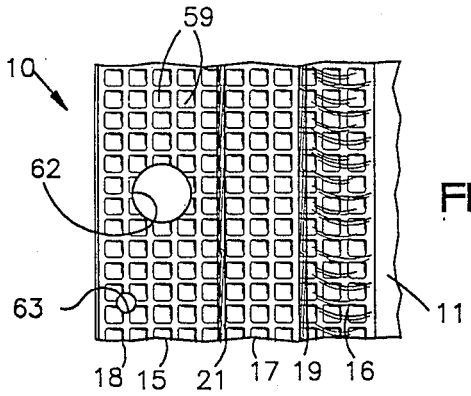
FIG. 8 is a side elevation of one of the flanges of a subsequent intermediate strip after the knurling or embossing operation.
Figure 8A:
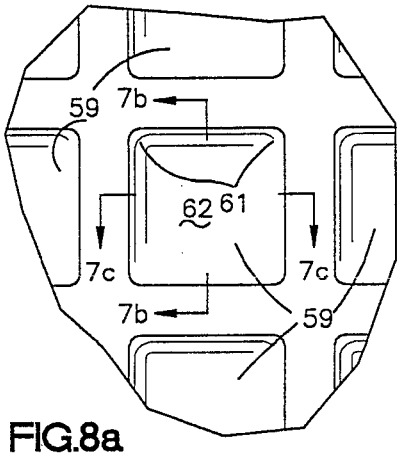
FIG. 8*a* is an enlarged, fragmentary view illustrating the shape of the embossments formed in the flange illustrated in FIG. 8 during the knurling operation.
Figure 8B:
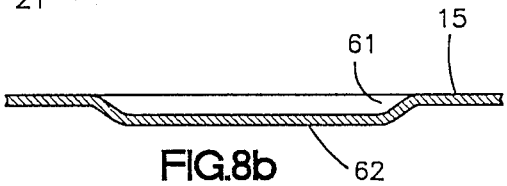
FIG. 8*b* is a fragmentary section, taken along line 8*b*—8*b* of FIG. 8*a*.
Figure 8C:
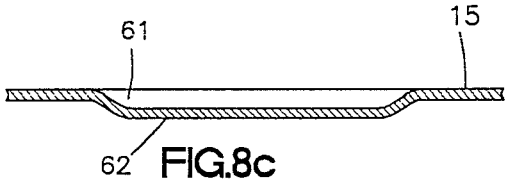
FIG. 8*c* is a fragmentary section, taken along line 8*c*—8*c* of FIG. 8*a*.

In the illustrated embodiment, the flanges are embossed with a multiplicity of small, square projections 59 located in laterally and longitudinally aligned rows of closely spaced projections. As best illustrated in FIGS. 8*a* through 8*c*, the projections 59 are square, provide rounded corners 61 and an offset, planar wall portion 62. It should be understood that other shapes and patterns of projections can be used, and that the present invention is not limited to the particular embossed projections illustrated.

It has been found that by embossing or knurling the flanges 15, further straightening of the intermediate strip occurs. This is because the deformation performed during the knurling operation redistributes the internal stresses in the material of the flanges in a more uniform manner and compensates for variations in longitudinal length of the various elements of the flanges and the nose. The embossing, in the illustrated embodiment, extends to the edge of the strip, as best illustrated in FIG. 8, and includes the unthinned portions 22. This embossing operation not only improves the straightness of the intermediate strip, but also provides a roughened surface to which the joint compound can better adhere when the corner bead is installed for use and the corner is finished with joint compound.

Figure 9:
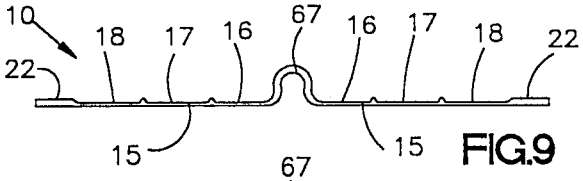
FIG. 9 is a cross section with the embossments eliminated for purposes of illustration of a subsequent intermediate strip in which the nose has been reformed to its final shape.

In the next operation, represented by the box 66, the strip is passed through rolls which finish-form the preliminary nose to the final nose configuration 67, illustrated in FIG. 9, to accurately size and shape the nose. The projections 59 are not illustrated in FIG. 9 to simplify the drawings.

Figure 10:
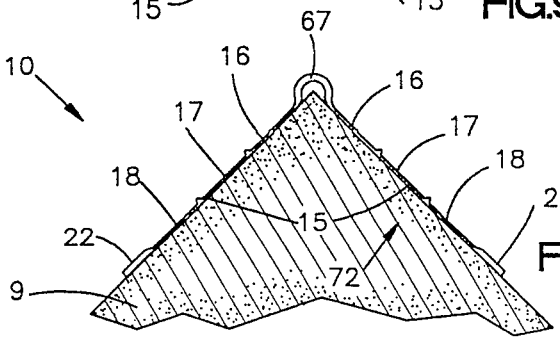
FIG. 10 is a cross section similar to FIG. 9 of the final strip of corner bead prior to its being cut to length.

In the last forming operation, represented by the box 71, the two flanges 15 are bent to extend at substantially right angles relative to each other to produce the final cross section of the finished corner bead 72 illustrated in FIG. 10. Preferably, the flanges extend at an angle slightly less than 90°. Here again, the projections are not illustrated to simplify the drawings. Thereafter, the strip is cut off at the desired lengths, as represented by the box 76, to complete the manufacturing operation of the corner bead 72.

Figure 16:
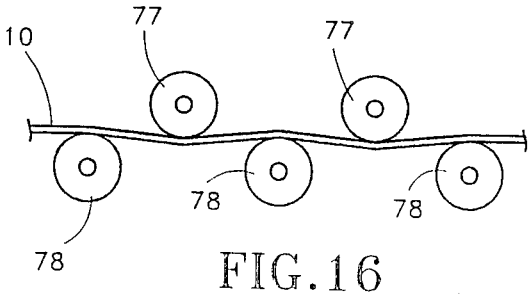
FIG. 16 is a schematic side elevation of a set of straightening rolls which may be substituted for or provided in addition to the straightening operation illustrated in FIG. 14.

If desired, a straightening operation can be performed by passing the flattened strip formed in the operation of the box 51, and illustrated in FIG. 6, through straightening rolls illustrated schematically in FIG. 16. Such straightening rolls include a plurality of rolls 77 which engage one face of the strip and a plurality of rolls 78 which engage the opposite face on opposite sides of the associated rolls 77. The two sets of rolls 77 and 78 are positioned so that the strip is flexed back and forth in a direction normal to the flanges 15 as the strip passes between the rolls. The rolls of the set 77 which engage the side of the strip from which the preliminary nose 11 extends are notched out so as to prevent the flattening of the nose.

Such straightening rolls tend to stretch the preliminary nose 11 and the flanges to a uniform length, and function to improve the straightness of the intermediate strip being processed. The straightening rolls of FIG. 16 can be substituted for the straightening operation illustrated in FIGS. 1, 5, and 14, or can be performed in addition to such operation.

The finished corner bead in accordance with the present invention is preferably formed from a hot dip galvanized strip of metal on which a zinc corrosion coating has been previously applied and can be produced utilizing the exact material and coating which have heretofore been used to produce conventional prior art corner strip. However, with the present invention the initial strip can be about twenty-one percent narrower while producing a finished corner bead having exactly the same overall dimensions as a prior art conventional corner bead. This substantial savings in the material required to produce the corner bead is achieved without degrading in any way the functional qualities of the finished corner bead and without resulting in any material change in the manner in which the corner bead is installed.

Such savings in material costs are extremely important, since it is conventional to form corner bead in rolling mills with substantially no labor expense. Further, the rolling mill for producing corner bead in accordance with the present invention, although somewhat more complex than conventional rolling mills, can be operated at the same line speeds previously employed during the manufacture of conventional prior art corner bead.

The corner bead produced in accordance with this invention is identical to some prior art corner bead except for the fact that the flanges 15 are each formed with thinned bands extending lengthwise of the corner bead. The finished nose 67 remains at the original thickness of the strip, and therefore provides the same strength and rigidity present in the prior art corner beads.

Although the preferred embodiments of this invention have been shown and described, it should be understood that various modifications and rearrangements of the parts may be resorted to without departing from the scope of the invention as disclosed and claimed herein.

What is claimed is:

1. In a wall structure including two planar wall portions intersecting at a corner, and a corner bead mounted on said corner with a flange secured to each of said wall portions, the improvement comprising said corner bead including a single strip of metal providing a shaped nose having a first thickness, and each of said flanges having a shear-deformed band extending lengthwise thereof having a reduced thickness substantially less than said first thickness.

2. In a wall structure as set forth in claim 1 wherein each flange provides a plurality of longitudinal bands of reduced thickness separated by portions of greater thickness.

3. In a wall structure as set forth in claim 2, wherein said flanges provide edge portions remote from said nose having a thickness greater than said reduced thickness.

4. In a wall structure as set forth in claim 1, wherein said flanges provide edge portions remote from said nose having a thickness greater than said reduced thickness.

5. In a wall structure as st forth in claim 1, wherein said flanges are embossed to provide an irregular surface to relieve stresses therein and provide a bond with joint compound.

6. In a wall structure as set forth in claim 5, wherein said flanges provide openings therein at intervals along their length.

7. In a wall structure as set forth in claim 1, wherein said corner bead contains substantially less metal per unit length than a similar corner bead without said thinned bands.

8. In a wall structure as set forth in claim 1, wherein said corner bead contains at least about fifteen percent less metal per unit length than a similar corner bead without said thinned bands.

9. In a wall structure as set forth in claim 1, wherein said corner bead provides a corrosion-resistant coating applied to said metal prior to forming said metal into said corner bead.

10. In a wall structure as set forth in claim 9, wherein said corrosion-resistant coating is zinc.

11. In a wall structure as set forth in claim 3, wherein said bands adjacent to said nose have internal stresses operating to lengthen said nose and improve the straightness of said corner bead.

12. A wall structure as set forth in claim 1, wherein each of said bands includes a plurality of separate shear-deformed longitudinally extending band portions, each band having a width substantially equal to the sum of the widths of said band portions forming said bands.

13. A wall structure comprising two planar wall portions intersecting at a corner, a corner bead mounted on said corner, said corner bead including a single strip of metal providing a shaped nose having a first thickness and a flange extending from each side of said nose at substantially right angles relative to each other, each flange being secured to one of said wall portions adjacent to said corner, each flange having a shear deformed band extending lengthwise thereof having a reduced thickness substantially less than said first thickness.

14. In a wall structure including two planar wall portions intersecting at a corner, and a corner bead mounted on said corner providing a flange extending along and fastened to each of said wall portions, the improvement comprising said corner bead being a metal strip providing a longitudinally extending nose having a first thickness, at least one of said flanges providing a longitudinally extending band of reduced thickness substantially thinner than said first thickness, whereby said corner bead contains less metal per unit length than a similar corner bead without said band of reduced thickness, said band including a plurality of separate shear-deformed longitudinally extending band portions, said band having a width substantially equal to the sum of the widths of said band portions forming said band.

15. In a wall structure as set forth in claim 14, wherein each flange provides a band of reduced thickness.

16. In a wall structure including two planar wall portions intersecting at a corner, and a corner bead mounted on said corner having flanges extending along said wall portions and secured thereto, the improvement comprising said corner bead including a single strip of metal providing a lengthwise extending nose along the center of said strip, said nose and an edge band along the extremities of said flanges remote from said nose having a first predetermined thickness, said flanges between said nose and edge band having longitudinally extending portions of reduced thickness substantially less than said predetermined thickness produced by shear deformation of said strip.

* * * * *

UNITED STATES PATENT AND TRADEMARK OFFICE

CERTIFICATE OF CORRECTION

PATENT NO. : 4,876,837

DATED : October 31, 1989

INVENTOR(S) : Patrick M. Kelly et al.

It is certified that error appears in the above-identified patent and that said Letters Patent is hereby corrected as shown below:

On the title page, under item [56]:

Under References Cited, 8th reference, "Balinsky" should be --Balinski--.

Col. 1, line 25, "bY" should be --by--.

Col. 2, line 7, after "accomplished" insert --,--.

Col. 2, line 50, after "embodiment" insert --,--.

Col. 2, line 61, after "bead" insert --,--.

Col. 3, line 60, "prior to its being cut to length" should be --mounted on the corner of a wall--.

Col. 4, line 57, "Work" should be --work--.

Col. 4, line 66, "Which" should be --which--.

Col. 6, line 12, "ar" should be --are--.

Col. 7, line 61, after "72." insert --When installed, the finished corner bead 72 is mounted on a wall 9, as illustrated in Fig. 10.--

Col. 8, line 18, after "applied" insert --,--.

Signed and Sealed this

Twenty-seventh Day of November, 1990

*Attest:*

HARRY F. MANBECK, JR.

*Attesting Officer*

*Commissioner of Patents and Trademarks*